US011744751B2

(12) United States Patent
Lee

(10) Patent No.: US 11,744,751 B2
(45) Date of Patent: Sep. 5, 2023

(54) WHOLE BODY SCRUB MACHINE FOR WASHING GENERAL FAMILY AND BEDRIDDEN PATIENTS

(71) Applicant: Kyu Song Lee, Amherst, NY (US)

(72) Inventor: Kyu Song Lee, Amherst, NY (US)

( * ) Notice: Subject to any disclaimer, the term of this patent is extended or adjusted under 35 U.S.C. 154(b) by 192 days.

(21) Appl. No.: 17/074,063

(22) Filed: Oct. 19, 2020

(65) Prior Publication Data

US 2022/0117810 A1 Apr. 21, 2022

(51) Int. Cl.

| | |
|---|---|
| ***A61G 7/00*** | (2006.01) |
| ***A47K 3/12*** | (2006.01) |
| ***A61H 33/06*** | (2006.01) |
| ***A61G 7/10*** | (2006.01) |

(52) U.S. Cl.

CPC ..... *A61G 7/0005* (2013.01); *A47K 3/125* (2013.01); *A61G 7/1003* (2013.01); *A61H 33/06* (2013.01); *A61H 33/066* (2013.01); *A61H 2033/061* (2013.01); *A61H 2033/062* (2013.01); *Y10S 5/90* (2013.01); *Y10S 5/928* (2013.01)

(58) Field of Classification Search

CPC .... A61G 7/0005; A61G 7/001; A61G 7/1003; A61G 7/08; A61G 7/02; A61G 13/0027; Y10S 5/928; Y10S 5/90; A47K 3/122; A47K 3/125; A47K 3/12; A61H 9/00; A61H 2009/0035; A61H 2009/0042; A61H 33/06; A61H 2033/061; A61H 2033/062; A61H 33/063; A61H 33/065; A61H 33/066; A61H 33/067; A61H 2033/068; A61H 33/08; A61M 21/0094

See application file for complete search history.

(56) References Cited

U.S. PATENT DOCUMENTS

| | | | | |
|---|---|---|---|---|
| 2,593,982 A | | 4/1952 | Cash | |
| 2,840,072 A | | 6/1958 | Stearns | |
| 4,192,296 A | | 3/1980 | St. Mary | |
| 4,751,918 A | | 6/1988 | Bernard et al. | |
| 5,054,472 A | | 10/1991 | Stefan | |
| 5,136,735 A | * | 8/1992 | Zimmerman | A61G 7/0005 4/597 |
| 5,228,150 A | * | 7/1993 | Parker | A61H 9/00 4/557 |
| 6,419,650 B1 | | 7/2002 | Ryan et al. | |
| 2001/0025389 A1 | * | 10/2001 | Kitamura | A61H 33/6036 4/538 |
| 2017/0056263 A1 | | 3/2017 | Ead | |

FOREIGN PATENT DOCUMENTS

| | | | | |
|---|---|---|---|---|
| JP | H05253262 A | * | 10/1993 | |
| KR | 200314257 Y1 | * | 5/2003 | |
| KR | 20110136003 A | * | 12/2011 | A61H 9/00 |

OTHER PUBLICATIONS

"Planar." Merriam-Webster.com Dictionary, Merriam-Webster, https://www.merriam-webster.com/dictionary/planar. Accessed Jan. 23, 2023. (Year: 2022).*

* cited by examiner

*Primary Examiner* — David R Hare
*Assistant Examiner* — Deborah Talitha Gedeon
(74) *Attorney, Agent, or Firm* — Micheal J. Feigin, Esq.; Feigin and Fridman LLC

(57) ABSTRACT

A device for caring for a human subject is disclosed. The device includes a frame including a base surfaces and side surfaces, and defining a hollow, and a liquid receptacle disposed beneath the frame. A conduit fluidly connects the hollow to the liquid receptacle. A cover is connected to the frame above the hollow. The cover includes a plurality of nozzles.

15 Claims, 7 Drawing Sheets

WHOLE BODY SCRUB MACHINE FOR WASHING GENERAL FAMILY AND BEDRIDDEN PATIENTS

FIELD OF THE DISCLOSED TECHNOLOGY

The disclosed technology relates generally to health and hygiene and, more specifically, to a device for moving and cleaning medical patients who are bedridden, comatose, or otherwise unable to move independently.

BACKGROUND OF THE DISCLOSED TECHNOLOGY

Bedsores are a problem for many bedridden patients, who cannot move around independently. Such patients often also suffer from poor hygiene, because they must be washed by a caregiver, who must physically move around the bedridden patient, without the patient being actively involved in the process.

One known method of avoiding bedsores is by regularly moving the patient around in the bed, or shifting the patient's position, so that pressure is applied to different portions of the patient's body at different times. However, this may be difficult to do when the patient cannot move their own muscles to assist, actively, in the repositioning of their body. Thoroughly washing the body of such patients is equally difficult, for the same reason—washing the whole body requires moving the patient around to access all parts of their body, which is difficult to do when the patient cannot actively cooperate.

Therefore, there exists a need in the art for a device and method to assist medical staff and caregivers in moving and/or washing patients who cannot independently move their muscles, such as a bedridden patients, paralyzed patients, or comatose patients.

SUMMARY OF THE DISCLOSED TECHNOLOGY

The disclosed technology relates generally to health and hygiene and, more specifically, to a device for moving and cleaning medical patients who are bedridden, comatose, or otherwise unable to move independently. The technology is related to a bathtub used in houses which is water and energy efficient. The device can be used for a healthy person to clean especially parts of the body which are inaccessible with one's hands.

According to a first aspect of some embodiments of the teachings herein, there is provided a device for caring for a human subject. The device includes a frame including a base surfaces and side surfaces, and defining a hollow, and a liquid receptacle disposed beneath the frame. A conduit fluidly connects the hollow to the liquid receptacle. A cover is connected to the frame above the hollow. The cover includes a liquid receiving chamber and a plurality of nozzles. When liquid is disposed in the liquid receiving chamber and the cover is in a closed operative orientation thereof, the liquid is emitted from the liquid receiving chamber, via the plurality of nozzles, into the hollow, and flows from the hollow via the conduit to the liquid receptacle.

In some embodiments, the device further includes a patient base, removably disposed within the hollow of the frame. The patient base includes a plurality of cylindrical rollers connected to each other, and independently rotatable relative to each other. The rollers are adapted to enable rolling and moving of the human subject when the human subject is lying on the patient base.

In some embodiments, the device further includes a plurality of channels, extending between the rollers, in fluid communication with the conduit.

In some embodiments, the patient base further includes a pillow portion disposed at a head end of the patient base, the pillow portion being raised relative to the cylindrical rollers.

In some embodiments, the cover is shorter than the frame, such that when the cover is in the closed operative orientation, a head end of the patient base is disposed outside of the cover. In some such embodiments, the cover has a side wall including a portal, such that when the human subject lies on the patient base with his head disposed at the head end, the portal is disposed about a neck of the human subject.

In some embodiments, a head portion of the patient base is rotatable relative to a leg portion of the patient base, so as to raise the head portion of the patient base.

In some embodiments, the liquid receiving chamber includes an inlet, connectable to a liquid source, for supplying liquid to the liquid receiving chamber.

In some embodiments, the liquid receptacle further includes a selectively closable drain.

In some embodiments, the device further includes a plurality of legs attached to the liquid receptacle, each of the legs terminating in a wheel, the legs and the wheels adapted to facilitate moving of the device.

According to the first aspect of some embodiments of the teachings herein, there is also provided a method of preventing bedsores in a bedridden human subject. The method includes placing the bedridden human subject in the device of the first aspect as described herein, such that the bedridden human subject is lying on the patient base. Subsequently, rolling at least one of the plurality of rollers relative to at least one other of the plurality of rollers, thereby to move at least a portion of the body of the bedridden human subject.

According to the aspect of some embodiments of the teachings herein, there is further provided a method of washing a bedridden human subject. The method includes placing the bedridden human subject in the device of the first aspect as described herein, and moving the cover into the closed operative orientation. Subsequently, a pressurized aqueous solution is provided into the liquid receiving chamber, such that the aqueous solution flows through the nozzles onto the bedridden human subject, and is collected into the liquid receptacle via the conduit.

According to a second aspect of some embodiments of the teachings herein, there is provided a device for caring for a human subject. The device includes a frame including a base surfaces and side surfaces, and defining a hollow, and a liquid receptacle disposed beneath the frame. A first conduit fluidly connects the hollow to the liquid receptacle. A cover is connected to the frame above the hollow. The cover includes a second conduit having a plurality of nozzles extending therefrom. When the cover is in a closed operative orientation thereof, liquid flows through the second conduit and is emitted therefrom, via the plurality of nozzles, into the hollow, and flows from the hollow via the first conduit to the liquid receptacle.

In some embodiments, the device further includes a patient base, removably disposed within the hollow of the frame. The patient base includes a plurality of cylindrical rollers connected to each other, and independently rotatable relative to each other. The rollers are adapted to enable rolling and moving of the human subject when the human subject is lying on the patient base.

In some embodiments, the device further includes a plurality of channels, extending between the rollers, and in fluid communication with the first conduit.

In some embodiments, the cover is shorter than the frame, such that when the cover is in the closed operative orientation, a head end of the patient base is disposed outside of the cover. In some such embodiments, the cover has a side wall including a portal, such that when the human subject lies on the patient base with his head disposed on at the head end, the portal is disposed about a neck of the human subject.

In some embodiments, a portion of the second conduit extends out of the cover, via a bore in the side wall including the portal, such that at least one of the plurality of nozzles is disposed over the head end outside the cover.

In some embodiments, a head portion of the patient base is rotatable relative to a leg portion of the patient base, so as to raise the head portion of the patient base.

According to the second aspect of some embodiments of the teachings herein, there is further provided a method of preventing bedsores in a bedridden human subject. The method includes placing the bedridden human subject in the device according to the second aspect, such that the bedridden human subject is lying on the patient base. Subsequently, rolling at least one of the plurality of rollers relative to at least one other of the plurality of rollers, thereby to move at least a portion of the body of the bedridden human subject.

According to the second aspect of some embodiments of the teachings herein, there is also provided a method of washing a bedridden human subject. The method includes placing the bedridden human subject in the device according to the second aspect, and moving the cover into the closed operative orientation. Subsequently, a pressurized aqueous solution is provided into the second conduit, such that the aqueous solution flows through the nozzles onto the bedridden human subject, and is collected into the liquid receptacle via the first conduit.

According to a third aspect of some embodiments of the teachings herein, there is provided a device for caring for a human subject. The device includes a frame including a base surfaces and side surfaces, and defining a hollow, and a liquid receptacle disposed beneath the frame. A first conduit fluidly connects the hollow to the liquid receptacle. A cover is connected to the frame above the hollow. The cover includes a plurality of nozzles extending toward the hollow. When liquid is provided to the plurality of nozzles and the cover is in a closed operative orientation thereof, the liquid is emitted, via the plurality of nozzles, into the hollow, and flows from the hollow via the first conduit to the liquid receptacle.

In some embodiments, the cover includes a liquid receiving chamber, in fluid communication with the plurality of nozzles. When the fluid is disposed in the liquid receiving chamber and the cover is in the closed operative orientation, the liquid is emitted from the liquid receiving chamber, via the plurality of nozzles, into the hollow. In some such embodiments, the liquid receiving chamber includes an inlet, connectable to a liquid source, for supplying liquid to the liquid receiving chamber.

In some embodiments, the cover includes a second conduit in fluid communication with the plurality of nozzles. When the fluid flows through the second conduit and the cover is in the closed operative orientation, the liquid is emitted from the second conduit, via the plurality of nozzles, into the hollow.

In some embodiments, the second conduit extends through a bore in a wall of the cover outside of the cover, and includes at least one nozzle disposed outside of the cover. In some other embodiments, a bore is formed in a side wall of the cover, and a portion of the second conduit, including at least one of the plurality of nozzles, is adapted to be taken out of the cover, via the bore.

In some embodiments, the device further includes a patient base, removably disposed within the hollow of the frame. The patient base includes a plurality of cylindrical rollers connected to each other, and independently rotatable relative to each other. The rollers are adapted to enable rolling and moving of the human subject when the human subject is lying on the patient base.

In some embodiments, the device further includes a plurality of channels, extending between the rollers, and in fluid communication with the conduit.

In some embodiments, the cover is shorter than the frame, such that when the cover is in the closed operative orientation, a head end of the patient base is disposed outside of the cover. In some such embodiments, the cover has a side wall including a portal, such that when the human subject lies on the patient base with his head disposed on at the head end, the portal is disposed about a neck of the human subject.

In some embodiments, a head portion of the patient base is rotatable relative to a leg portion of the patient base, so as to raise the head portion of the patient base.

According to the third aspect of some embodiments of the teachings herein, there is also provided a method of preventing bedsores in a bedridden human subject. The method includes placing the bedridden human subject in the device according to the third aspect, such that the bedridden human subject is lying on the patient base. Subsequently, rolling at least one of the plurality of rollers relative to at least one other of the plurality of rollers, thereby to move at least a portion of the body of the bedridden human subject.

According to the third aspect of some embodiments of the teachings herein, there is further provided a method of washing a bedridden human subject. The method includes placing the bedridden human subject in the device according to the third aspect and moving the cover into the closed operative orientation. Subsequently, a pressurized aqueous solution is provided to the plurality of nozzles, via the liquid receiving chamber or via the second conduit, such that the aqueous solution flows through the nozzles onto the bedridden human subject, and is collected into the liquid receptacle via the first conduit.

DETAILED DESCRIPTION OF EMBODIMENTS OF THE DISCLOSED TECHNOLOGY

In an embodiment of the disclosed technology, a device for moving and cleaning a bedridden patient includes a frame, in which is disposed a base formed of a plurality of cylindrical rollers, movable relative to each other. A cover is hingedly attached to the frame, the cover including a plurality of nozzles through which water, soap, or any other liquid substances may be emitted onto the base. A liquid receptacle is disposed below the frame to receive liquid emitted onto the base, and includes a drain for removal of liquid from the device.

Embodiments of the disclosed technology will become clearer in view of the following description of the drawings.

Figure 1:
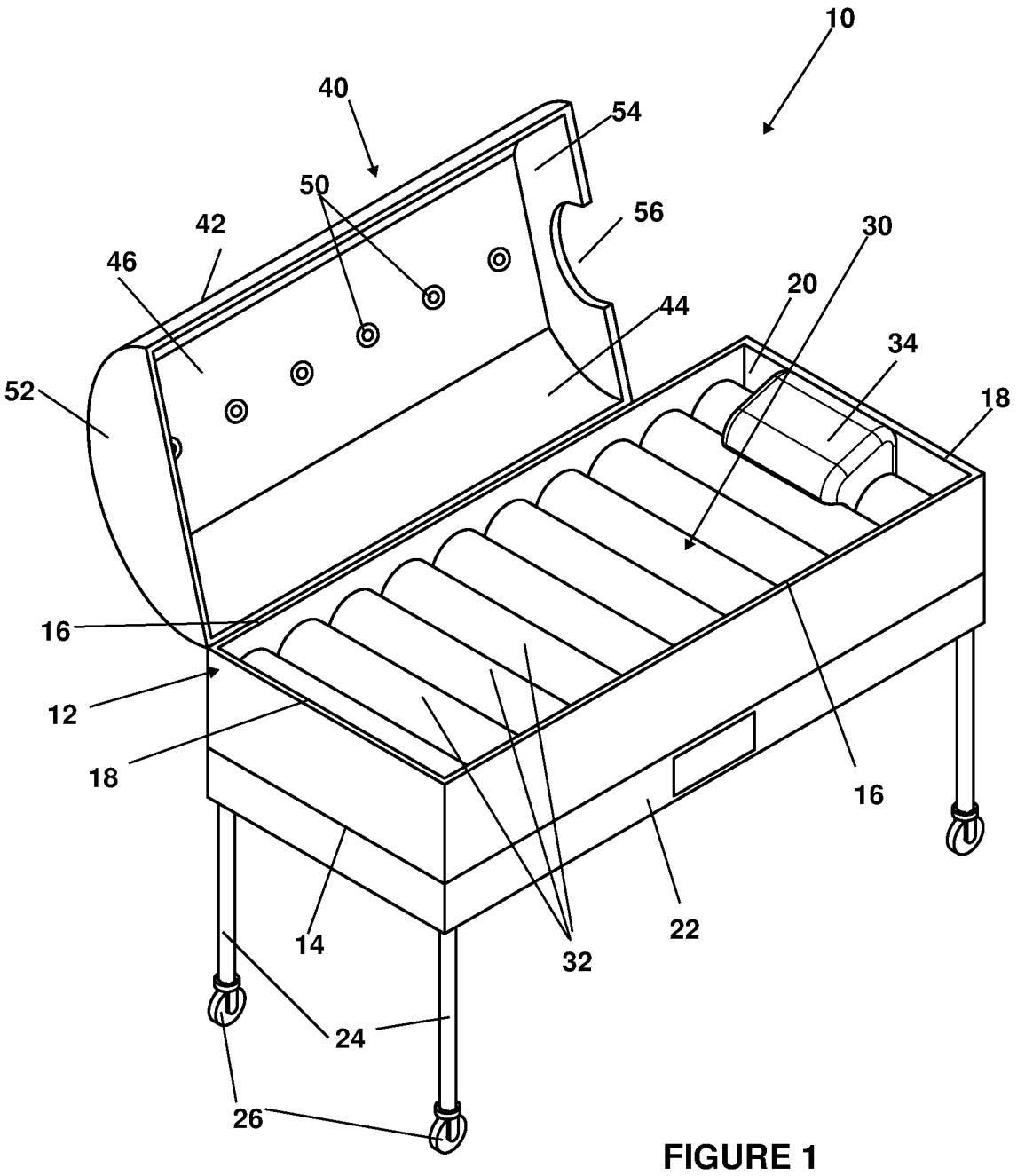
FIG. 1 shows a perspective view illustration of a device for moving and cleaning a patient, according to an embodiment of the disclosed technology, in an open operative orientation.
Figure 2A:
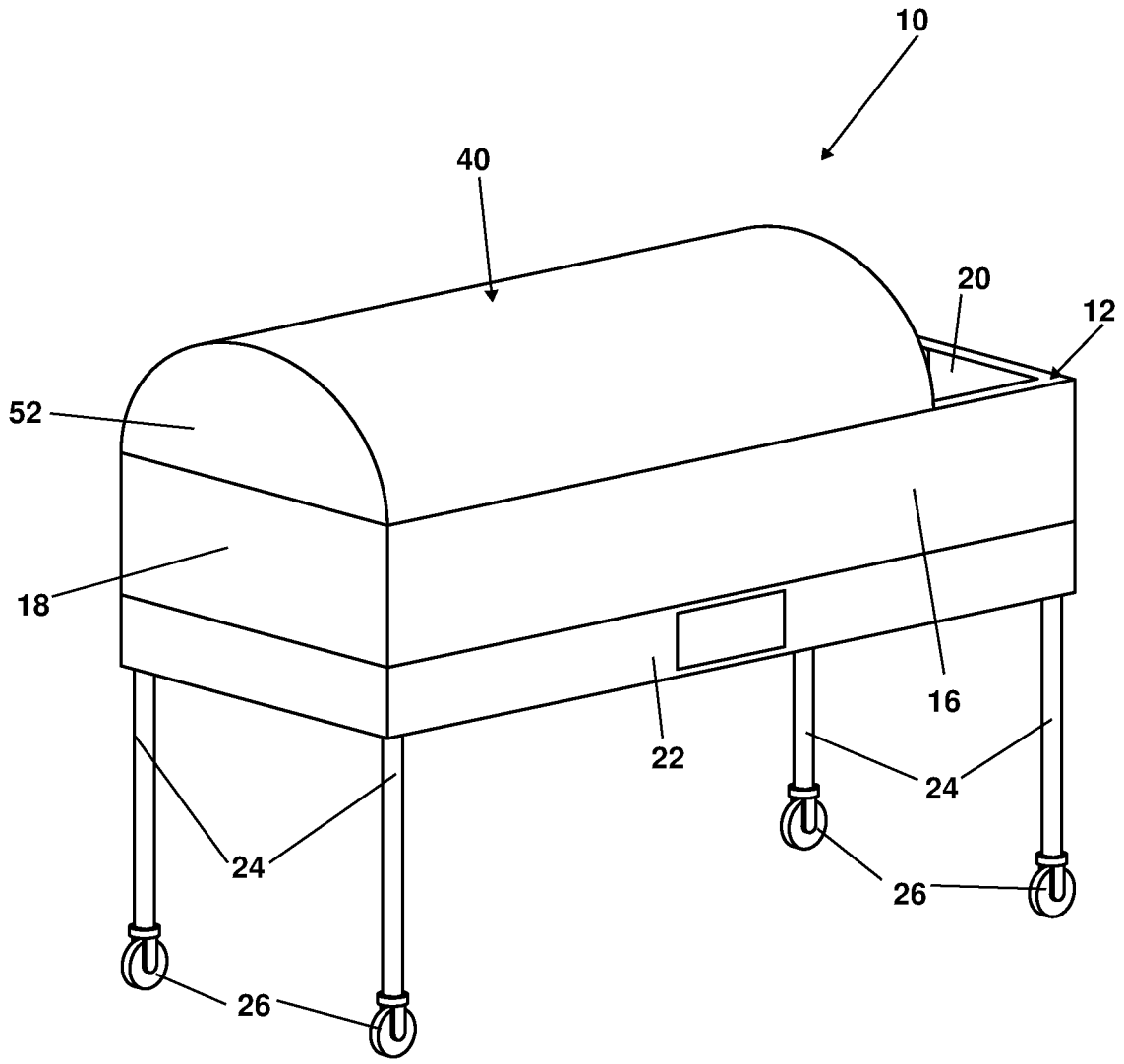
FIGS. 2A and 2B show two perspective view illustrations of the device for moving and cleaning a patient, according to an embodiment of the disclosed technology, in a closed operative orientation
Figure 2B:
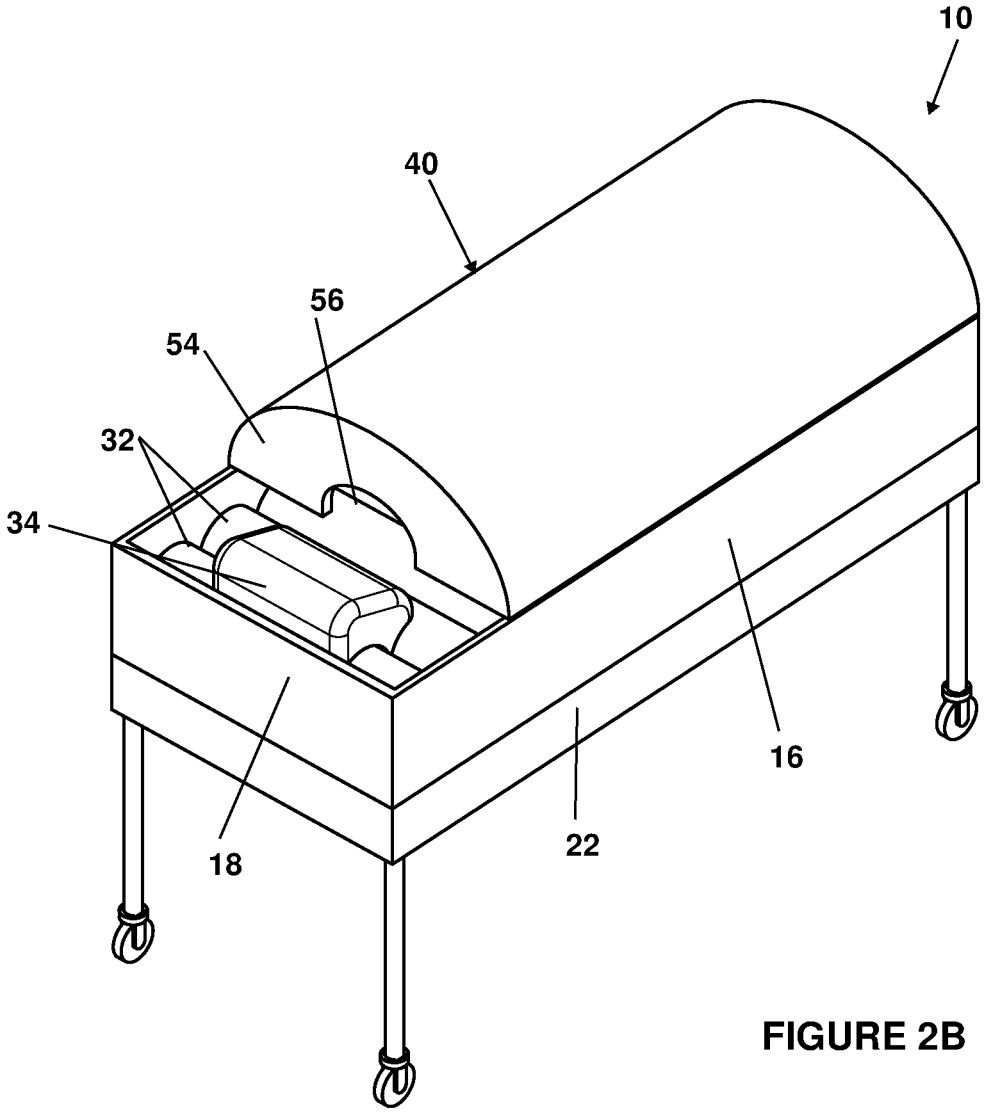

Reference is now made to FIGS. 1, 2A, and 2B, which show perspective view illustrations of a device 10 for moving and cleaning a patient, according to an embodiment of the disclosed technology. FIG. 1 shows the device 10 in an open operative orientation, and FIGS. 2A and 2B show the device 10 in a closed operative orientation.

As seen, device 10 includes a rectangular frame 12 including a base surface 14 (seen clearly in FIG. 3), two longitudinal frame sides 16, and two lateral frame sides 18. The frame forms a hollow 20 (seen clearly in FIG. 3). A liquid receptacle 22 disposed beneath frame 12, and is in fluid communication therewith, via a suitable conduit. Liquid receptacle has the same longitudinal and lateral dimensions as the frame. Four legs 24 extend downwardly from liquid receptacle 22 at corners thereof, each terminating in a wheel 26, facilitating easy moving of the device 10.

Disposed within hollow 20 of frame 12 is a patient base 30, formed of a plurality of cylindrical rollers 32, each independently rotatable relative to each other. A pillow portion 34 is disposed at one end of patient base 30, and is raised relative to the rollers.

A cover 40 is hingedly connected to frame 12 along a longitudinal side 16 thereof. An outer surface 42 of cover 40 has a generally hemispherical cross section. However, the inner surface 44 of cover 40 has a planar segment 46, truncating the hemispherical shape, and forming a liquid receiving chamber between the inner surface 44 and the outer surface 42. A plurality of nozzles 50 are disposed along planar segment 46, the nozzles adapted to emit, into hollow 20 or onto patient base 30, fluid from the liquid receiving chamber, as seen clearly in FIG. 1. Cover 40 further includes an inlet (not explicitly shown) through which water or another liquid is inserted into the liquid receiving chamber.

Cover 40 includes a first, substantially hemispherical, side wall 52, and a second, substantially hemispherical, side wall 54 including a portal 56. The length between side walls 52 and 54 is shorter than the length of frame 12. Cover 40 is hingedly connected to frame 12, such that in the closed operative orientation shown in FIGS. 2A and 2B, first side wall 52 is aligned with one of lateral walls 18. Second side wall 54 is disposed over the hollow 20 and patient base 30, such that pillow portion 34 is outside of cover 40, as seen clearly in FIG. 2B.

Figure 3:
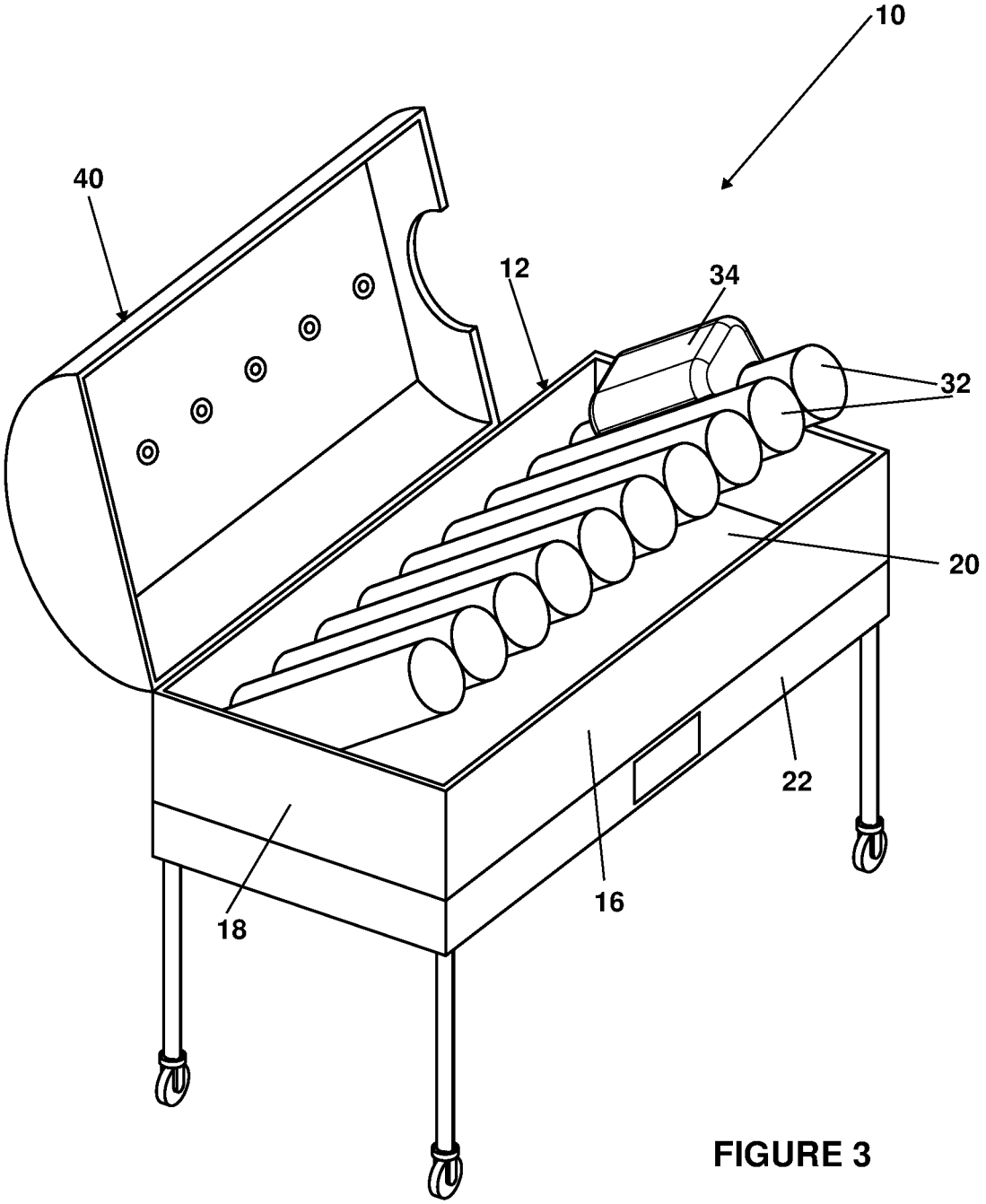
FIG. 3 shows a perspective view illustration of the device for moving and cleaning a patient, according to an embodiment of the disclosed technology, in a device cleaning operative orientation.

Reference is now made to FIG. 3, which is a perspective view illustration of the device 10 in a device cleaning operative orientation. As seen in FIG. 3, patient base 30, including cylindrical rollers 32 and pillow portion 34, may be angled relative to frame 12, and may be removed from hollow 22. This may be required for several reasons, such as to clean or sterilize the patient base between patients, to remove soap residues from the patient base, or to unblock a clog in the conduit connecting the hollow 20 of the frame and the liquid receptacle 22.

Figure 4:
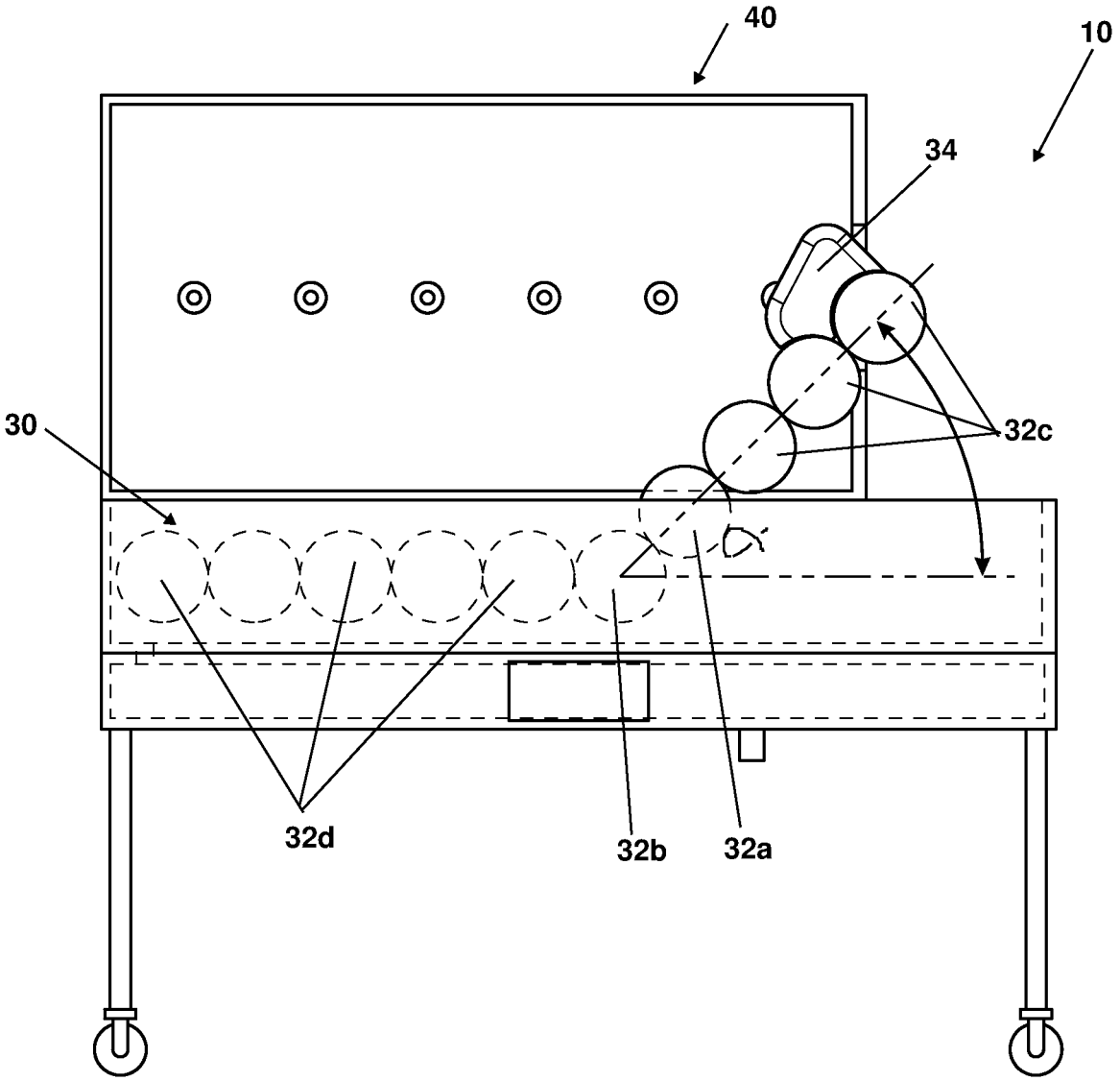
FIG. 4 shows a side view planar illustration of the device for moving and cleaning a patient, according to an embodiment of the disclosed technology, in a head-raised operative orientation.

FIG. 4 shows a side view planar illustration of device 10, in a head-raised operative orientation. As seen, in some embodiments, cylindrical roller may be angled relative to each other, so as to raise a portion of patient base 30 relative to the remainder of patient base 30. In the illustrated embodiment, cylindrical roller 32*a* is rotated relative to cylindrical roller 32*b*. Cylindrical rollers 32*c* remain in a single plane with cylindrical roller 32*a* and form a head portion of the patient base. Cylindrical rollers 32*d* remain in a single plane with cylindrical roller 32*b*, and form a leg portion of the patient base 30. In this arrangement, the head portion of patient base 30, including pillow portion 34, is angled relative to the leg portion by an angle i".

It is appreciated that the head-raised operative orientation may only be used when the cover 40 is open. It is further appreciated that, though the head-raised operative orientation is illustrated as raising a certain fraction of the patient base 30 by a certain degree, the raised portion of patient base 30 may include more, or fewer, cylindrical rollers than those shown. Additionally, in some embodiments, the leg portion of patient base 30 may be raised relative to the head portion, in a manner similar to that shown.

Figure 5:
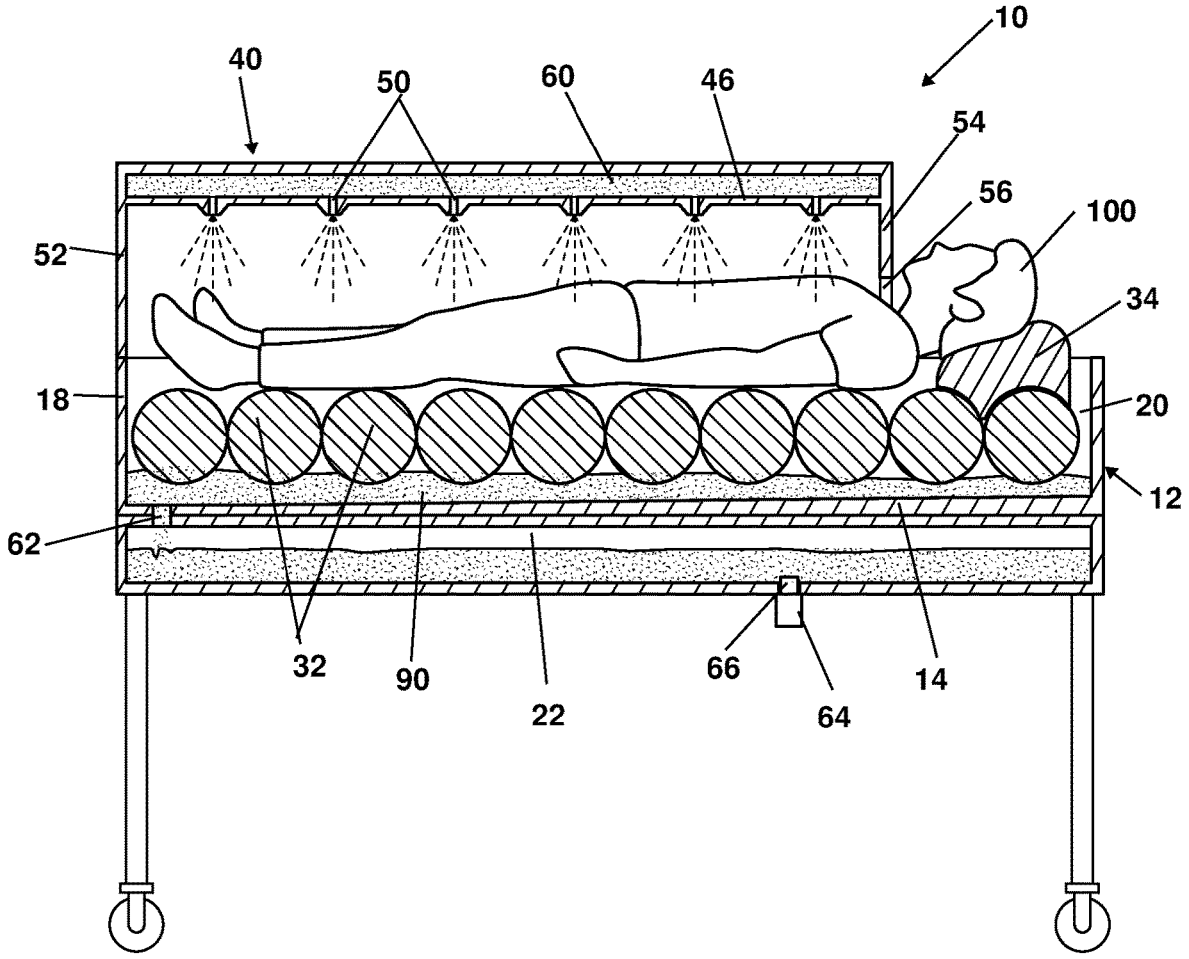
FIG. 5 shows a sectional view of the device for moving and cleaning a patient, according to an embodiment of the disclosed technology, during washing of the patient.

FIG. 5 shows a sectional view of the device 10, during use thereof for washing of a patient 100. As seen, the patient is lying on patient base 30, with his head resting on pillow portion 34. Cover 40 is closed, such that the patient's neck extends through portal 56, and the cover does not enclose his head. Water, or any other liquid, disposed within liquid receiving chamber 60, is emitted onto the patient via nozzles 50, for example to wash the patient. The water collects in hollow 20 of the frame, between and beneath cylindrical rollers 32, and flows, via conduit 62, from hollow 20 into liquid receptacle 22. When desired, a user, such as a caregiver of patient 100, may open the stopper 64 on drain 66, to drain the liquid from liquid receptacle 22. In some embodiments, channels are formed between the rollers 32, via which liquid may flow to the conduit 62.

Still referring to FIG. 5, in some embodiments of the disclosed technology, the device 10 is used as a sweat bath (schvitz) which provides steam emanating upwards from below the person. In this embodiment, a steam bed 90 with a plurality of portals (shown as dots, by way of example of placement thereof), releases steam (water vapor) which, being warmer than the ambient air, extends above the rollers 32 and envelops the person 100 within the interior of the device 10. Water vapor then exists out the top of the device. In such embodiments, the conduit 62 receives vapor or liquid water from below for upwards movement thereof and drain 66 becomes a water inlet 66 and/or functions as each an inlet and drain at different times.

In still further embodiments, the nozzles 50 function as an one of a water outlet (liquid water), a steam outlet (water vapor), or a combination thereof. In this manner, steam can be pumped into the chamber from above and below if desired, or, a combination of water and steam can be used simultaneously or at different times using the same device hardware.

Figure 6:
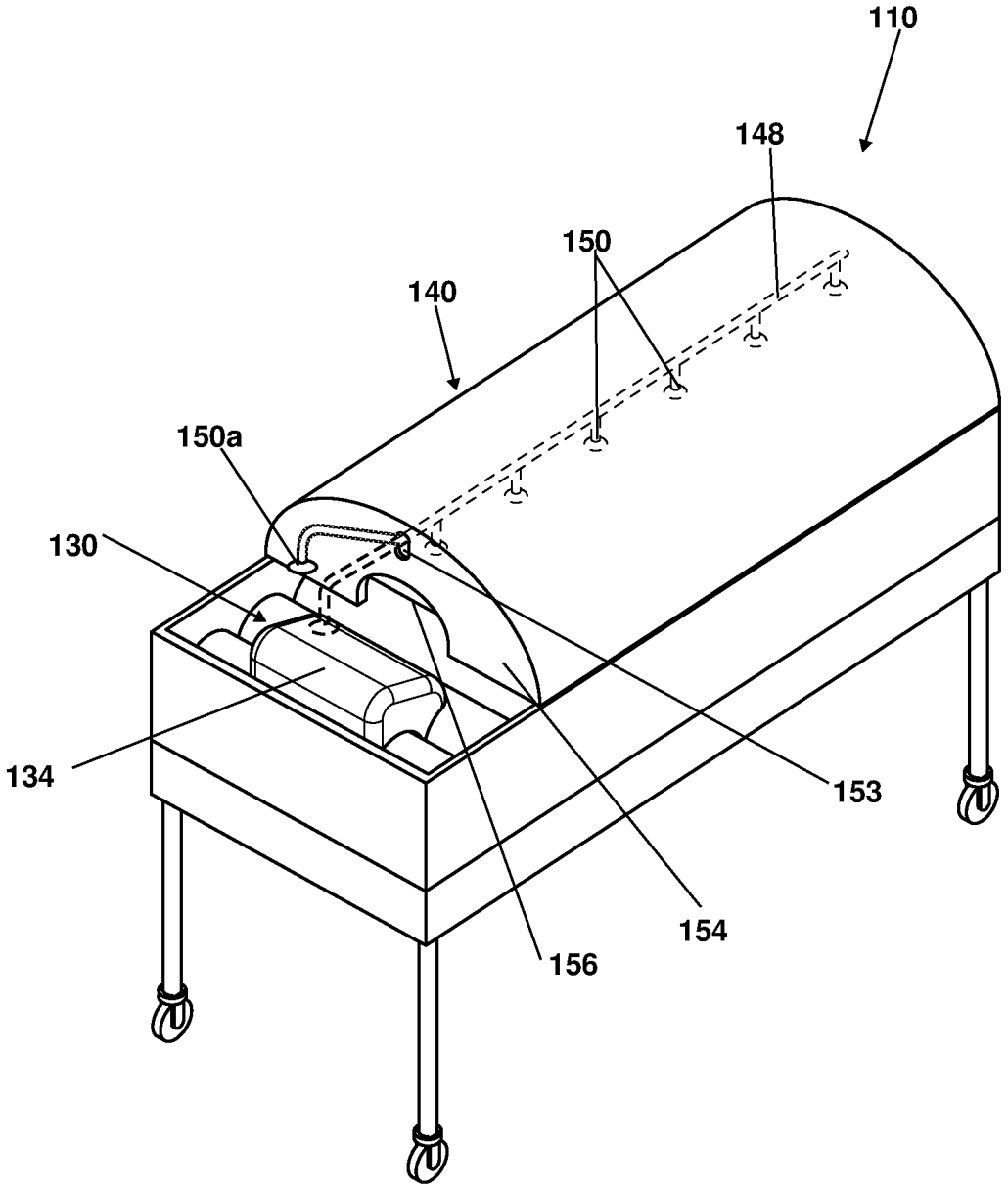
FIG. 6 shows a perspective view illustration of a device for moving and cleaning a patient, according to another embodiment of the disclosed technology, in a closed operative orientation.

Turning now to FIG. 6, the Figure shows a perspective view illustration of a device 110 for moving and cleaning a patient, according to another embodiment of the disclosed technology, in a closed operative orientation. Device 110 is similar to device 10 of FIGS. 1 to 5, with like number representing like element. Device 110 differs from device 10 in the liquid supply mechanism. Instead of a liquid receiving chamber in the cover, cover 140 of device 110 includes a second conduit 148, from which extend nozzles 150. The second conduit 148 is connectable to a liquid source, such as to a faucet, for providing liquid, such as water, thereto.

In some embodiments, a bore 153 is formed in side wall 154 of the cover 140, above portal 156. Second conduit 148, and at least one nozzle 150*a*, are adapted to extend out of cover 140, via bore 153, such that nozzle 150*a* is disposed above a head end of patient base 130. In some embodiment, second conduit 148, or at least the portion thereof disposed outside cover 140, is flexible, such that a height of nozzle 150*a* is adjustable relative to pillow portion 134. In some embodiments, the portion of second conduit 148 disposed outside cover 140 may be pushed into cover 140, via bore 153, for example for storage of device 110.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A device for caring for a human subject, the device comprising: a frame including a base surfaces and side surfaces, and defining a hollow; a liquid receptacle in fluid communication with said frame to receive liquid from said frame, said liquid receptacle disposed beneath said frame and coextensive in longitudinal and lateral dimensions with said frame; a conduit fluidly connecting said hollow to said liquid receptacle; and a cover hingedly connected to said frame above said hollow, said cover including an inner surface, an outer surface, a hemispherical cross-section, and a planar segment spanning said cover, said planar segment forming a liquid receiving chamber on an interior of said cover between said inner surface and said outer surface and including a plurality of nozzles, a patient base, removably disposed within said hollow of said frame, said patient base including a plurality of cylindrical rollers connected to each other and independently rotatable relative to each other, each of said plurality of cylindrical rollers extending laterally across said frame configured to enable rolling and moving of the human subject longitudinally along the frame when the human subject is lying on the patient base and a plurality of channels, extending between said rollers, and in fluid communication with said conduit; wherein when liquid is disposed in said liquid receiving chamber and said cover is in a closed operative orientation thereof, said liquid is emitted from said liquid receiving chamber via said plurality of nozzles into said hollow, and flows from said hollow via said conduit to said liquid receptacle.

2. The device of claim 1, wherein said cover is shorter than said frame, such that when said cover is in said closed operative orientation, a head end of said patient base is disposed outside of said cover.

3. The device of claim 2, wherein said cover has a side wall including a portal, such that when the human subject lies on said patient base with his head disposed on at said head end, said portal is disposed about a neck of the human subject.

4. The device of claim 1, wherein a head portion of said patient base is rotatable relative to a leg portion of said patient base to raise said head portion of said patient base.

5. The device of claim 1, wherein said cover includes an inlet connectable to a liquid source for supplying liquid to said liquid receiving chamber.

6. A method of preventing bedsores in a bedridden human subject, the method comprising:

placing the bedridden human subject in the device of claim 1, such that the bedridden human subject is lying on the patient base;

rolling at least one of said plurality of rollers relative to at least one other of said plurality of rollers, thereby to move at least a portion of the body of the bedridden human subject.

7. A method of washing a bedridden human subject, the method comprising:

placing the bedridden human subject in the device of claim 1;

moving said cover into said closed operative orientation; and providing a pressurized aqueous solution into said liquid receiving chamber, such that said aqueous solution flows through said nozzles onto said bedridden human subject, and is collected into said liquid receptacle via said conduit.

8. The device of claim 1, wherein steam is placed into said device via inlets in said frame.

9. The device of claim 8 wherein steam is further placed into said device via at least some of said plurality of nozzles.

10. A device for caring for a human subject, the device comprising: a frame including a base surfaces and side surfaces, and defining a hollow including a patient base, said patient base having a head end for receiving the head of a human subject; a liquid receptacle in fluid communication with said frame to receive liquid from said frame, said liquid receptacle disposed beneath said frame and coextensive in longitudinal and lateral dimensions with said frame; a first conduit fluidly connecting said hollow to said liquid receptacle; and a cover hingedly connected to said frame above said hollow, said cover including a sidewall having a portal extending through said sidewall, a bore disposed above said portal and extending through said sidewall, and a second conduit having a plurality of nozzles extending therefrom, said portal disposed about the neck of said human subject when said human subject lies on said patient base with said head of said human subject disposed on said head end, a portion of said second conduit extending out of said cover through said bore such that at least one of said plurality of nozzles is disposed over said head end outside said cover; said patient base including a plurality of cylindrical rollers connected to each other and independently rotatable relative to each other and a plurality of channels, extending between said rollers, and in fluid communication with said first conduit; wherein, when said cover is in a closed operative orientation thereof, liquid flows through said second conduit and is emitted therefrom via said plurality of nozzles into said hollow and flows from said hollow via said first conduit to said liquid receptacle.

11. The device of claim 10, wherein said patient base is removably disposed within said hollow of said frame, wherein each of said plurality of cylindrical rollers extend laterally across said frame and are configured to enable rolling and moving of the human subject longitudinally along the frame when the human subject is lying on the patient base.

12. The device of claim 11, wherein a head portion of said patient base is rotatable relative to a leg portion of said patient base to raise said head portion of said patient base.

13. A method of preventing bedsores in a bedridden human subject, the method comprising:

placing the bedridden human subject in the device of claim 11, such that the bedridden human subject is lying on the patient base;

rolling at least one of said plurality of rollers relative to at least one other of said plurality of rollers, thereby to move at least a portion of the body of the bedridden human subject.

14. The device of claim 10, wherein said cover is shorter than said frame, such that when said cover is in said closed operative orientation, said head end of said patient base is disposed outside of said cover.

15. A method of washing a bedridden human subject, the method comprising:

placing the bedridden human subject in the device of claim 10;

moving said cover into said closed operative orientation; and providing a pressurized aqueous solution into said second conduit, such that said aqueous solution flows through said nozzles onto said bedridden human subject, and is collected into said liquid receptacle via said first conduit.

* * * * *